US008475990B2

(12) United States Patent
Shishido

(10) Patent No.: US 8,475,990 B2
(45) Date of Patent: Jul. 2, 2013

(54) IMAGE FORMING METHOD AND METHOD OF SUPPRESSING FOGGING IN AN IMAGE FORMING APPARATUS

(75) Inventor: Makoto Shishido, Osaka (JP)

(73) Assignee: Kyocera Mita Corporation (JP)

( * ) Notice: Subject to any disclaimer, the term of this patent is extended or adjusted under 35 U.S.C. 154(b) by 718 days.

(21) Appl. No.: 12/045,876

(22) Filed: Mar. 11, 2008

(65) Prior Publication Data

US 2008/0232850 A1 Sep. 25, 2008

(30) Foreign Application Priority Data

Mar. 23, 2007 (JP) ..... 2007-076218

(51) Int. Cl.
*G03G 15/02* (2006.01)

(52) U.S. Cl.
USPC ..... 430/123.4; 430/125.1; 399/170; 399/171; 399/159

(58) Field of Classification Search
USPC ..... 399/170, 171, 159; 430/125.1, 123.4
See application file for complete search history.

(56) References Cited

U.S. PATENT DOCUMENTS

| | | | | |
|---|---|---|---|---|
| 3,944,356 | A * | 3/1976 | Hayne | 399/100 |
| 3,994,356 | A * | 11/1976 | Smitley | 180/282 |
| 5,183,718 | A | 2/1993 | Ueda | |
| 5,359,395 | A * | 10/1994 | Shimura et al. | 399/176 |
| 2006/0141377 | A1* | 6/2006 | Kuboshima et al. | 430/56 |
| 2007/0275314 | A1* | 11/2007 | Okada | 430/58.65 |

FOREIGN PATENT DOCUMENTS

| | | | |
|---|---|---|---|
| JP | 04238056 | | 8/1992 |
| JP | 8-278684 | | 10/1996 |
| JP | 09101656 | | 4/1997 |
| JP | 11184215 | | 7/1999 |
| JP | 200398702 | | 4/2003 |
| JP | 2003215890 | | 7/2003 |
| JP | 2005289877 | A * | 10/2005 |
| JP | 2006126672 | | 5/2006 |
| JP | 2006284679 | A * | 10/2006 |
| JP | 200711073 | | 1/2007 |
| JP | 2007232984 | A * | 9/2007 |

OTHER PUBLICATIONS

English language machine translation of JP 2006-284679 (Oct. 2006).*

English language machine translation of JP 2007-232984 (Sep. 2007).*

Borsenberger, Paul M. et al. Organic Photoreceptors for Imaging Systems. New York: Marcel-Dekeer, Inc. (1993) pp. 6-17.*

English language machine translation of JP 2005-289877 (Oct. 2005).*

* cited by examiner

*Primary Examiner* — Christopher Rodee

(74) *Attorney, Agent, or Firm* — Gerald E. Hespos; Michael J. Porco; Matthew T. Hespos

(57) ABSTRACT

An image forming method includes using a charging device to charge a surface of a monolayer-type electrophotographic photoconductor that contains a specific amine compound, setting a projection area of the charging device per time relative to the photo sensitive layer surface of the electrophotographic photoconductor to be S ($cm^2$), applying a current value to the charging device to be $I_{CC}$ (μA) and setting an inflow current value represented by $I_{CC}/S$ ($\mu A/cm^2$) to a value within the range of from 5 to 25 $\mu A/cm^2$.

7 Claims, 8 Drawing Sheets

IMAGE FORMING METHOD AND METHOD OF SUPPRESSING FOGGING IN AN IMAGE FORMING APPARATUS

BACKGROUND OF THE INVENTION

1. Field of the Invention

The present invention relates to an image forming apparatus using an electrophotographic photoconductor and an image forming method. In particular, the invention relates to an image forming apparatus using a monolayer type electrophotographic photoconductor capable of coping with a wide variety of rotational speeds and an image forming method using the image forming apparatus.

2. Description of the Related Art

Conventionally, an image forming apparatus used for printers, copying machines and the like adopts an image forming process in which charging means for charging an electrophotographic photoconductor, exposure means for exposing the charged photoconductor surface to form a latent image, developing means for transferring a toner to the latent image to develop it, transfer means for transferring the toner to a recording sheet to form an image, and electricity removing means for removing a residual potential remaining on the photoconductor surface after transfer are arranged in this order around a periphery of the electrophotographic photoconductor.

Here, the charging means can be roughly classified into charging means of a contact charging system for bringing a charging member such as a charging roller into direct contact with the surface of an electrophotographic photoconductor and charging means of a non-contact charging system for corona charging the surface of a photoconductor using a corona charger.

On the other hand, examples of organic photoconductors used include a photoconductor containing a charge generating agent (CGM) and a charge transfer agent (CTM) in a single photo sensitive layer, and a photoconductor produced by laminating a charge generating layer (CGL) and a charge transfer layer (CTL).

Stable charging properties of photoconductors are also divided into a negative charging property and a positive charging property. A negative charging photoconductor generates a large amount of ozone due to negative polarity corona, posing problems of an environmental pollution and a photoconductor deterioration due to ozone. Hence, since special discharging means or ozone decomposing means for preventing the problems from arising needs to be provided, a positive charging photoconductor is said to be excellent for a small size copying machine, facsimile, printer or the like.

As an image forming method of using such a positive charging photoconductor, a method is widely known that involves positively charging a positive charging type organic photoconductor by means of a corotron or scorotron and then carrying out a series of Carlson processes to form an image.

However, although a positive charging type organic photoconductor has the advantage of generating few amount of ozone during charging, the surface potential of the photoconductor gradually deteriorates along with repeated uses or long-term use, being liable to change also in image density.

In particular, when the rotational speed of an electrophotographic photoconductor is as high as 100 mm/sec or higher, both the contact and non-contact charging systems raise the problem of being prone to be large in the variation of a charging potential. This results in the problem that a partial charging failure is generated in an electrophotographic photoconductor, whereby fogging is easily generated in a formed image.

Under the circumstance, a method is disclosed in which in order to obtain a stable charging property even when charging means of a non-contact charging system is used in combination with a monolayer type electrophotographic photoconductor, a main charger provided with a charging member, a shield and a grid for a shield opening is used in main charging for the photoconductor, and the shield and the grid are maintained at a positive potential higher than zero while an inflow current ($I_{SC}+I_{CC}$) into the shield and grid is controlled to be 90% or less an inflow current ($I_{CC}$) into the main charger (see, e.g. Patent document 1).

[Patent document 1] JP-8-278684A (Claims)

However, even if the inflow current is adjusted, there is a problem in that ozone or the like is prone to be generated when the rotational speed of the electrophotographic photoconductor is as high as 100 mm/sec or higher. This inhomogeneously oxidizes and deteriorates the surface of the electrophotographic photoconductor, thereby changing the properties of the electrophotographic photoconductor surface in some cases. Thus, in such a case, even the image forming member of Patent document 1 has a problem in that the variation of a charging potential cannot be sufficiently decreased.

Accordingly, an image forming apparatus is needed that is capable of effectively decreasing the variation of the charging potential even in the case of the contact charging system or non-contact charging system or further in the case where the rotational speed of an electrophotographic photoconductor is relatively high.

SUMMARY OF THE INVENTION

Consequently, the present inventors have diligently studied and found that by using an amine compound having a specific structure as a hole transfer agent contained in a photo sensitive layer and by controlling a ratio of a current value applied to charging means to a projection area of the charging means per time relative to the photo sensitive layer surface to be in a predetermined range, it is possible to effectively suppress the oxidation deterioration of the electrophotographic photoconductor due to ozone or the like even in the case of a contact charging system or a non-contact charging system or further in the case where a rotational speed of an electrophotographic photoconductor is relatively high.

In other words, an object of the present invention is to provide an image forming apparatus that uses a predetermined monolayer type electrophotographic photoconductor as an electrophotographic photoconductor and controls a ratio of a current value applied to charging means to a projection area of the charging means per time relative to the photo sensitive layer surface to be in a predetermined range, whereby the variation of a charging potential can be decreased to thereby effectively suppress the generation of fogging, for example, even in the case where a rotational speed of an electrophotographic photoconductor is relatively high, and an image forming method using the image forming apparatus.

According to an aspect of the present invention, there is provided an image forming apparatus including charging means, exposure means, developing means, transfer means and electricity removing means arranged in this order around a periphery of an electrophotographic photoconductor, wherein, when a projection area of the charging means per time relative to the photo sensitive layer surface of the electrophotographic photoconductor is set to be S ($cm^2$) and a current value applied to the charging means is set to be $I_{CC}$ (μA), an inflow current value represented by $I_{CC}/S$ ($\mu A/cm^2$) is set to a value within the range of from 5 to 25 $\mu A/cm^2$, and the electrophotographic photoconductor is a monolayer type electrophotographic photoconductor containing in a same layer a charge generating agent, a hole transfer agent, an electron transfer agent and a binding resin and also an amine compound represented by the following general formula (1) is contained as the hole transfer agent, and thus, the above-described problems can be solved:

(1)

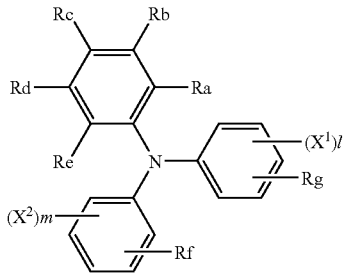

wherein Ra to Rg are each independently a hydrogen atom, a halogen atom, an alkyl group having 1 to 20 carbon atoms, an alkoxy group having 1 to 20 carbon atoms, or a substituted or unsubstituted aryl group having 6 to 30 carbon atoms, or two substituents of Ra to Re adjacent to each other may form a hydrocarbon ring structure; $X^1$ and $X^2$ are each independently a substituent represented by the following general formula (2), and when $X^1$ and $X^2$ or one of them is plural, each may be the same or different; and the substituent numbers 1 and m are 0 or positive integers satisfying ($1+m \geqq 2$):

(2)

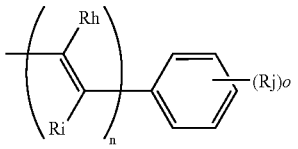

wherein Rh to Ri are each independently a hydrogen atom, an alkyl group having 1 to 20 carbon atoms, a substituted or unsubstituted aryl group having 6 to 30 carbon atoms; the repetition number n is an integer of 1 or 2; Rj is a halogen atom, an alkyl group having 1 to 20 carbon atoms, an alkoxy group having 1 to 20 carbon atoms, or a substituted or unsubstituted aryl group having 6 to 30 carbon atoms, and when Rj is plural, they may be the same or different; and the substituent number o is an integer of 0 to 5.

That is, an amine compound represented by general formula (1) as a hole transfer agent is contained in a photo sensitive layer of an electrophotographic photoconductor, and thus, its oxidation resistance can effectively suppress the oxidation deterioration of the electrophotographic photoconductor due to ozone or the like.

Therefore, the use of a monolayer type electrophotographic photoconductor as the electrophotographic photoconductor and also control of a ratio (hereinafter, may be referred to as an inflow current value) of a current value applied to charging means to a projection area of the charging means per time relative to the photo sensitive layer surface to be in a predetermined range make it possible to decrease the variation of the charging potential, thereby effectively suppressing the generation of fogging, even in the case where a rotational speed of an electrophotographic photoconductor is relatively high.

Upon constituting the image forming apparatus of the present invention, the rotational speed of the electrophotographic photoconductor is preferably set to a value within the range of from 70 to 280 mm/sec.

Even when image formation is performed in such a wide range of rotational speeds, the variation of the charging potential can be decreased to effectively restrain the generation of fogging.

In addition, upon constituting the image forming apparatus of the present invention, any two of Ra to Re in general formula (1) are preferably bonded to form a cyclohexyl group.

Constitution in this manner enables to further improve the dispersibility of a specified hole transfer agent in a photo sensitive layer. Thus, the oxidation resistance of the hole transfer agent having a specific structure can be effectively exhibited and also the sensitivity behavior of the electrophotographic photoconductor can be made to be improved as well.

Additionally, upon constituting the image forming apparatus of the present invention, $X^1$ and $X^2$ in general formula (1) or any one of them preferably have a butadiene structure in which the repetition number n in general formula (2) is set to 2.

With the constitution, the oxidation resistance of the hole transfer agent having a specific structure can be further improved, and the charge transfer speed can be improved to thereby further improve the sensitivity behavior.

Moreover, upon constituting the image forming apparatus of the present invention, an addition amount of the amine compound represented by general formula (1) is set to a value within the range of from 30 to 80 parts by weight based on 100 parts by weight of the binding resin.

With this constitution, the oxidation resistance of the hole transfer agent having a specific structure can be more effectively exhibited.

Furthermore, the dispersibility in the photo sensitive layer also can be further improved.

In addition, upon constituting the image forming apparatus of the present invention, the charging means is preferably a scorotron charging device.

Even the use of a scorotron charging device, which is charging means of a non-contact charging system can obtain excellent ozone resistance and excellent durability since it includes a specific electrophotographic photoconductor.

Additionally, according to another aspect of the present invention, there is provided an image forming method using any of the above-described image forming apparatuses.

In other words, when the image forming method is carried out, an amine compound represented by general formula (1) is contained as a hole transfer agent in a photo sensitive layer of an electrophotographic photoconductor, so that its oxidation resistance can effectively suppress the oxidation deterioration of the electrophotographic photoconductor surface due to ozone or the like.

As a result, when the image forming method is carried out, the use of a monolayer type electrophotographic photoconductor as the electrophotographic photoconductor and also control of a ratio of a current value applied to charging means to a projection area of the charging means per time relative to the photo sensitive layer surface to be in a predetermined range make it possible to decrease the variation of the charging potential, thereby effectively suppressing the generation of fogging.

DETAILED DESCRIPTION OF THE PREFERRED EMBODIMENTS

First Embodiment

A first embodiment is an image forming apparatus including charging means, exposure means, developing means, transfer means and electricity removing means arranged in this order around a periphery of an electrophotographic photoconductor, wherein, when a projection area of the charging means per time relative to a photo sensitive layer surface of the electrophotographic photoconductor is set to be S ($cm^2$) and a current value applied to the charging means is set to be $I_{CC}$ (μA), an inflow current value represented by $I_{CC}/S$ (μA/$cm^2$) is set to a value within the range of from 5 to 25 μA/$cm^2$, and the electrophotographic photoconductor is a monolayer type electrophotographic photoconductor containing in a same layer an charge generating agent, a hole transfer agent, an electron transfer agent and a binding resin, and also an amine compound represented by general formula (1) is contained as the hole transfer agent.

An image forming apparatus as the first embodiment is divided to each constitutional feature, which will be specifically described hereinafter.

1. Basic Constitution

Figure 1:
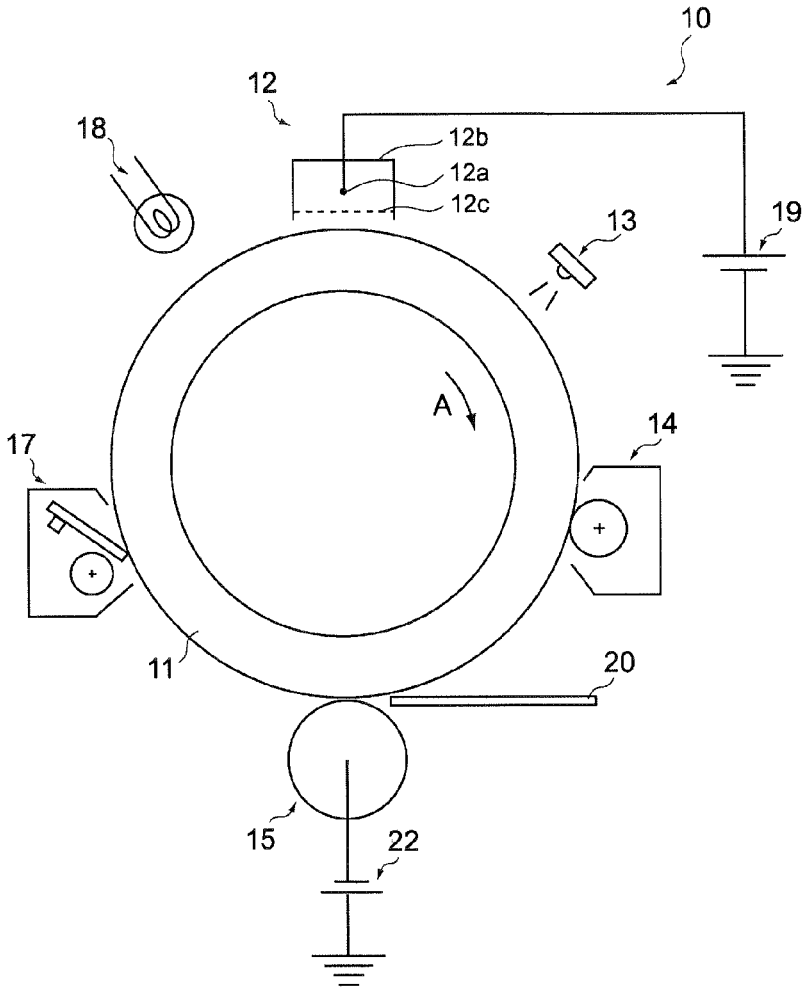
FIG. 1 is a schematic diagram of an image forming apparatus according to the present invention.

FIG. 1 shows a basic constitution of an image forming apparatus in the present invention. The image forming apparatus 10 includes a drum type electrophotographic photoconductor (hereinafter, may be called photoconductor) 11. Around w periphery of the photoconductor 11, there are sequentially arranged along a rotational direction indicated by the arrow A, charging means 12 (in the drawing, a scorotron charging device is illustrated as one example), exposure means 13 for forming a latent image on a surface of the photoconductor, developing means 14 for affixing a toner to the photoconductor surface to develop the latent image, transfer means 15 for transferring the toner onto a recording sheet 20, a cleaning device 17 for removing a toner remaining on the photoconductor surface, and electricity removing means 18 for removing a residual potential on the photoconductor surface.

The charging means 12 of a non-contact charging system as one example includes a discharging member 12*a* such as a corona wire, a shield 12*b* for surrounding the discharging member, and a grid member 12*c* arranged in a photoconductor side opening of the shield. Additionally, a power source 19 for applying a charging applied voltage is connected to the discharging member 12*a*. In this case, connection is made such that the polarity of the power source 19 on the side of the charging means 12 becomes a cathode, the image forming apparatus can be made to be a positive charging type, while if connection is made such that the polarity of the power source 19 on the side of the charging means 12 becomes an anode, the image forming apparatus can be made to be a negative charging type. Moreover, a voltage is applied also to the shield 12*b* and the grid member 12*c* from a powder source (not shown).

Moreover, a power source 22 is connected to the transfer means 15. The polarity of the power source 22 is determined by the positive or negative charging type in the photoconductor 11 and the forward or reverse direction of the development system, etc.

Note that the photoconductor 11 is characterized, as described below, by being a monolayer type electrophotographic photoconductor and containing a hole transfer agent having a specific structure in its photo sensitive layer.

2. Charging Means (1) Kind

Charging means in the present is not particularly limited, and both charging means of a non-contact charging system and charging means of a contact charging system can be suitably used.

For example, when a corotron or scorotron charging device is used as charging means of a non-contact charging system, there is normally the problem of the generation of ozone or the like. However, according to the image forming apparatus provided with the electrophotographic photoconductor of the present invention, the electrophotographic photoconductor is excellent in ozone resistance and also a ratio of a current value applied to the charging means to a projection area of the charging means per time relative to the photo sensitive layer surface is limited to a predetermined range, whereby excellent durability can be obtained.

Accordingly, both the charging means of non-contact and contact charging systems can decrease the variation of a charging potential in the electrophotographic photoconductor, thereby effectively suppressing the generation of fogging.

(2) Inflow Current Value

When a projection area of the charging means per time relative to the photo sensitive layer surface of the electrophotographic photoconductor is set to be S ($cm^2$) and a current value applied to the charging means is set to be $I_{CC}$ (μA), an inflow current value represented by $I_{CC}/S$ (μA/$cm^2$) is characteristically set to a value within the range of from 5 to 25 μA/$cm^2$.

This is because if the inflow current value ($I_{CC}/S$) becomes a value smaller than 5 μA/$cm^2$, sufficiently charging the electrophotographic photoconductor may be becomes difficult in some cases, while if the inflow current value ($I_{CC}/S$) exceeds 25 μA/$cm^2$, the variation of a charging potential may be extremely large.

Moreover, when the inflow current value ($I_{CC}/S$) is within the range, the situation can be readily coped with, even in the case where the charging potential when charging is varied, or where an optimized charging potential is made changed due to the deterioration of the electrophotographic photoconductor.

As a consequence, the inflow current value ($I_{CC}/S$) is more preferably set to a value within the range of from 7 to 23 $\mu A/cm^2$, still more preferably set to a value within the range of from 10 to 22 $\mu A/cm^2$, most preferably set to a value within the range of from 15 to 20 $\mu A/cm^2$.

Figure 2:
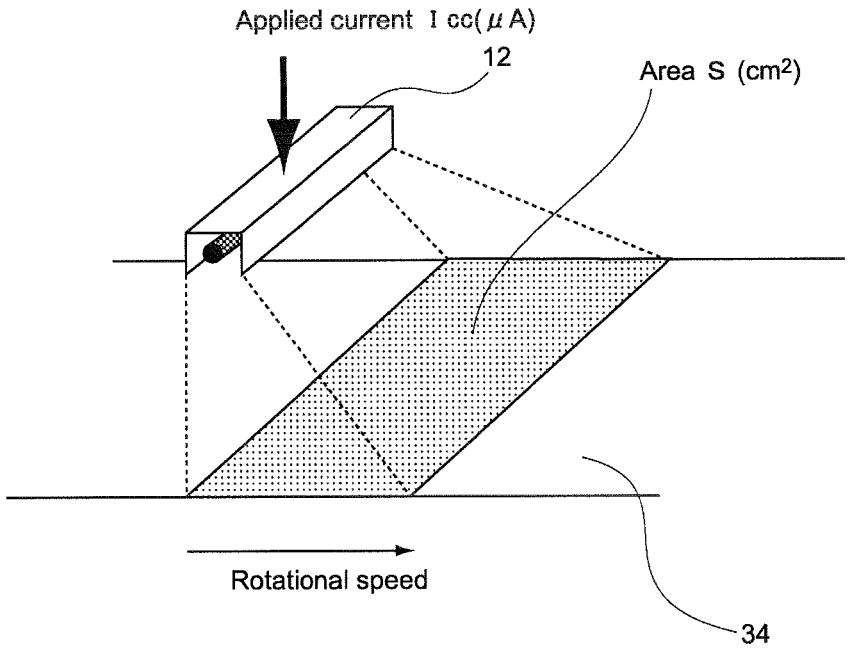
FIG. 2 is a diagram for explaining an inflow current value in the present invention.

In the present invention, the inflow current value represented by ($I_{CC}/S$) refers to a value represented by $I_{CC}/S$ ($\mu A/cm^2$) when the projection area of the charging means (12) per time relative to the photo sensitive layer (34) surface of the electrophotographic photoconductor is set to be S ($cm^2$) and the current value applied to the charging means (12) is set to be $I_{CC}$ ($\mu A$), as illustrated in FIG. 2.

Herein, the projection area of the charging means (12) per time relative to the photo sensitive layer (34) surface of the electrophotographic photoconductor stands for, in other words, the area S ($cm^2$) of the photo sensitive layer (34) surface of the electrophotographic photoconductor passing under the charging means (12) per time.

Additionally, in FIG. 2, the photo sensitive layer (34) surface is depicted as a flat plane for convenience; however, the shape of the photo sensitive layer is not particularly limited to a flat plane.

Next, a method of calculating the inflow current value represented by ($I_{CC}/S$) in the present invention will be specifically described.

For example, when the current applied to the charging means is set at 3,000 $\mu A$, the width of the charging means is set to 250 mm (25 cm) and the rotational speed of the electrophotographic photoconductor is set at 120 mm/sec (12 cm/sec), the inflow current value represented by ($I_{CC}/S$) is calculated in the flowing, with the result of being 10 $\mu A/cm^2$.

$(I_{CC}/S)=3{,}000\ \mu A/(25\ cm \times 12\ cm)=10\ (\mu A/cm^2)$

3. Electrophotographic Photoconductor (1) Basic Constitution

In the present invention, a monolayer type electrophotographic photoconductor is characteristically used as the electrophotographic photoconductor.

The reason is that a monolayer type electrophotographic photoconductor can be readily produced because of a simple layer structure as compared with a multilayer type electrophotographic photoconductor and also has advantages in that an optical property is readily improved, and the like, due to few layer interfaces.

On the other hand, since the monolayer type electrophotographic photoconductor has a constitution containing a charge generating agent in the photo sensitive layer, the electric resistance of the photo sensitive layer tends to be small. Hence, continuous formation of images poses the problem in that the variation of a charging potential is liable to be enlarged. As a result, because of the variation of the charging potential, there is a problem in that in that fogging is liable to occur in a formed image. In particular, such a problem becomes remarkable in particular when the electrophotographic photoconductor surface is ununiformly oxidized and deteriorated due to ozone or the like generated attributable to a voltage applied to the charging means.

However, in the present invention, the use of the hole transfer agent having a specific structure excellent in oxidation resistance as set forth below can stabilize the charging property of the electrophotographic photoconductor so as to solve the problem.

Figure 3A:
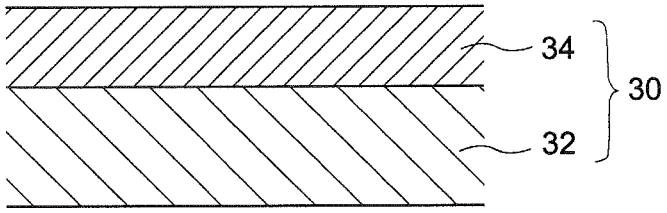
FIGS. 3A and 3B are diagrams each explaining a constitution of a monolayer type electrophotographic photoconductor in the present invention.

As illustrated in FIG. 3A, a monolayer type electrophotographic photoconductor 30 is produced by disposing a single photo sensitive layer 34 on a substrate 32.

Moreover, the photo sensitive layer can include a binding resin, a hole transfer agent having a specific structure and a charge generating agent and further, as required, an additive such as an electron transfer agent, a leveling agent or a compound having a silyl group.

Figure 3B:
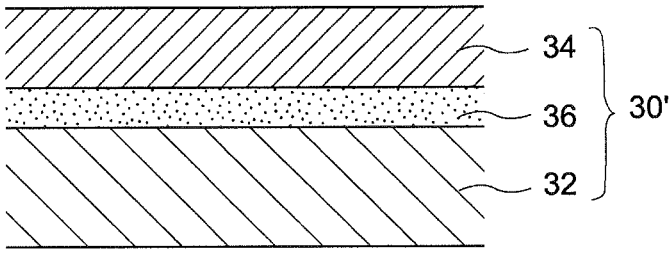

Furthermore, as indicated in FIG. 3B, a monolayer type photoconductor 30' may be acceptable that has a barrier layer 36 formed between the substrate 32 and the photo sensitive layer 34 within the range of not prohibiting the characteristics of the photoconductor.

In addition, further inclusion of an electron transfer agent as a charge transfer agent can further improve the charge transfer efficiency between the charge generating agent and the hole transfer agent.

Additionally, a variety of materials having electroconductivity can be used as the substrate, and examples thereof include metals such as iron, aluminum, copper, tin, platinum, silver, vanadium, molybdenum, chromium, cadmium, titanium, nickel, palladium, indium, stainless steel and brass; plastic materials produced by vapor-depositing or laminating the above listed metals; glass coated with aluminum iodide, tin oxide, indium oxide or the like; and plastic materials having dispersed therein electroconductive fine particles such as carbon black.

Moreover, the shapes of the substrate may include any of a sheet shape, a drum shape and the like that can match the structures of image forming apparatuses to be used, and the substrate itself may have electroconductivity or the substrate surface may have electroconductivity.

(2) Hole Transfer Agent (2)-1 Kind

In the present invention, an amine compound represented by general formula (1) as described above can be characteristically the hole transfer agent.

The reason is that the use of an amine compound represented by general formula (1) as a hole transfer agent, due to its oxidation resistance, can effectively suppress oxidation deterioration of the electrophotographic photoconductor surface caused by ozone or the like.

Thus, even in the case where a monolayer type electrophotographic photoconductor is used as an electrophotographic photoconductor and charging means of a non-contact or contact charging system is used as charging means, the variation of a charging potential can be decreased, thereby effectively suppressing the generation of fogging.

In other words, as described in the section "Charging Means", when charging means of a non-contact or contact charging system is used in combination with a monolayer type electrophotographic photoconductor, the fact that the oxidation deterioration of the photo sensitive layer caused by ozone or the like to be generated and the electric resistance of the monolayer type photo sensitive layer are relatively small causes a problem in that the variation of a charging potential is liable to increase during continuous image formation. This results in the problem that fogging in a formed image is prone to occur due to the generation of partial charge failure.

On the other hand, since in the present invention, the photo sensitive layer of the electrophotographic photoconductor contains a hole transfer agent having a specific structure excellent in oxidation resistance, it is possible to stably suppress fogging for a long period of time if the fogging is caused by ozone or the like generated by little discharge.

Thus, even when a monolayer type electrophotographic photoconductor inferior in the stability of a charging potential is used as the electrophotographic photoconductor, the suppression of ununiform deterioration on its surface can decrease the variation of a charging potential, thereby effectively suppressing the generation of fogging.

In addition, in general formula (1), any two of Ra to Re are preferably bonded to form a cyclohexyl group.

The reason is that the structure of a predetermined site in general formula (1) is specified in this way, whereby it is possible to improve the dispersibility of a hole transfer agent having a specific structure in the photo sensitive layer. Therefore, the oxidation resistance of the hole transfer agent having a specific structure in the photo sensitive layer can be effectively exhibited and the sensitivity behavior of the electrophotographic photoconductor can also be improved.

In other words, the reason is that, by introducing a cyclohexyl group into a predetermined site in general formula (1), flattability and symmetry in the amine compound represented by general formula (1) is adjusted and crystallinity of the amine compound is decreased to enable improvement of compatibility to a coating solution for a photo sensitive layer.

Additionally, in general formula (1), $X^1$ and $X^2$ or any one of them preferably has a butadiene structure in which the repetition number n in general formula (2) is set to 2.

The reason is that the structure of a predetermined site in general formula (1) is specified in this way, so that it is possible to improve the oxidation resistance of the hole transfer agent having a specific structure and also rendering the charge transfer speed to be improved can further improve sensitivity behavior as well.

This effect is thought to be due to the cause that the incorporation of the butadiene structure into a predetermined site in general formula (1) enables π electrons to be increased to thereby further effectively transfer charge within the molecule.

(2)-2 Specific Example

Examples of the amine compound represented by general formula (1) can include amine compounds (HTM-1 to HTM-10) represented by the following formulae (3) to (12).

(3)

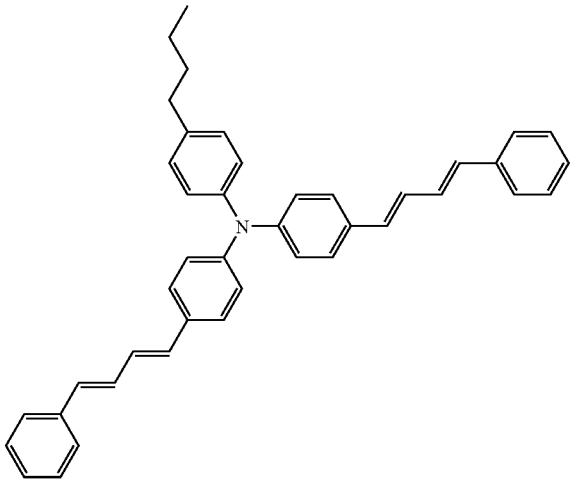

(HTM-1)

-continued (4)

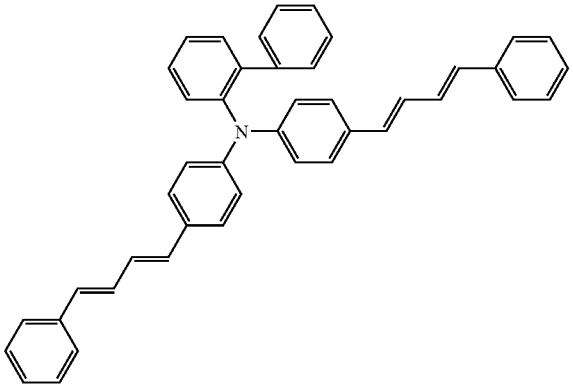

(HTM-2)

(5)

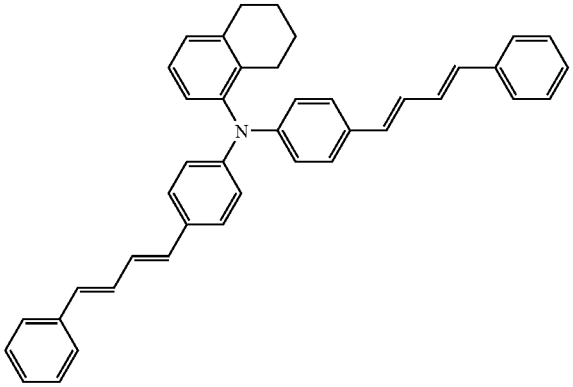

(HTM-3)

(6)

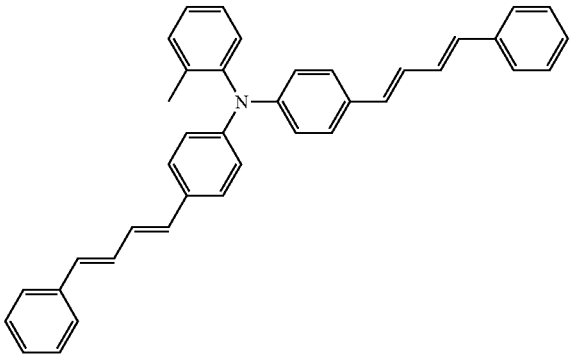

(HTM-4)

-continued (7)

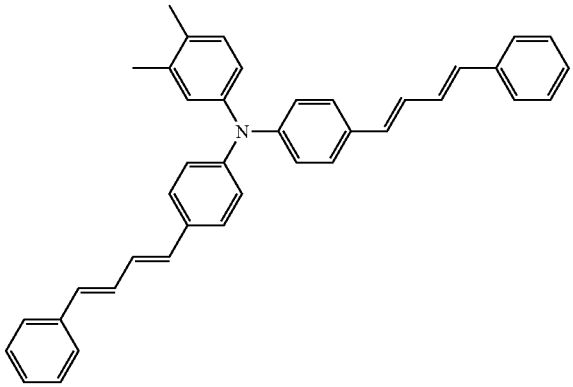

(HTM-5)

(8)

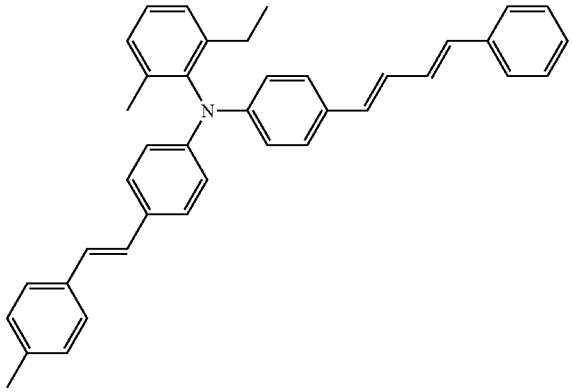

(HTM-6)

(9)

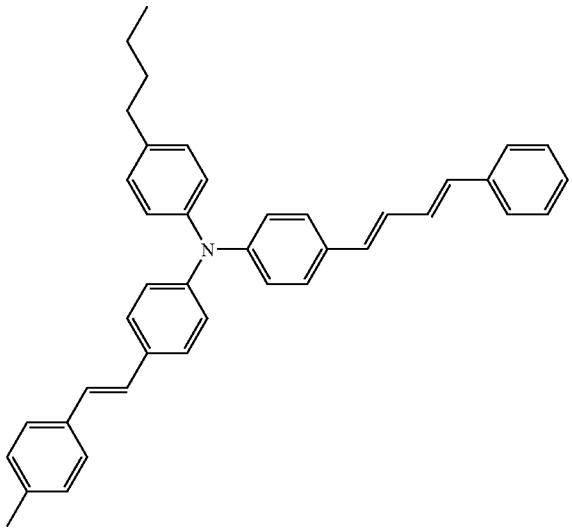

(HTM-7)

-continued (10)

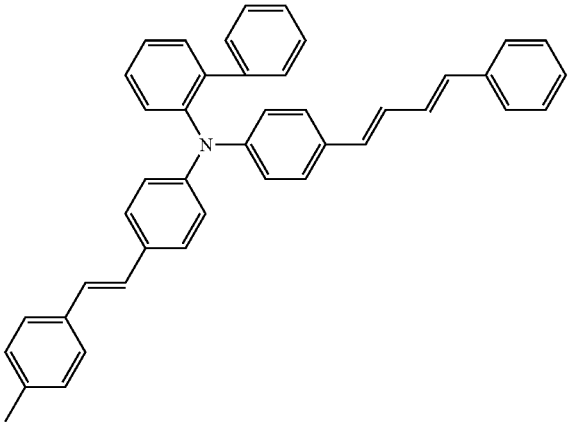

(HTM-8)

(11)

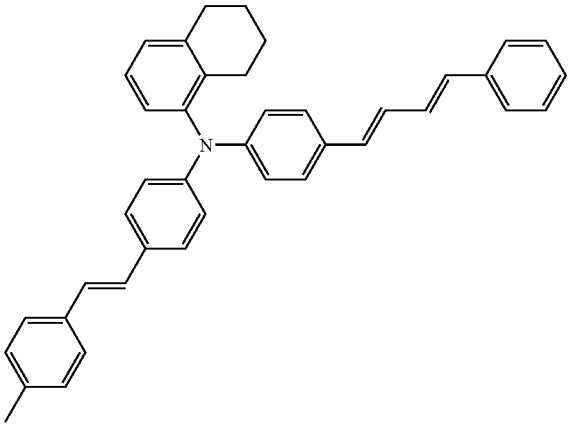

(HTM-9)

(12)

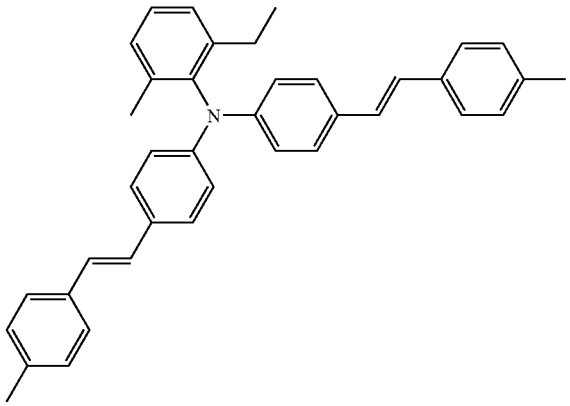

(HTM-10)

(2)-3 Addition Amount

Furthermore, the addition amount of the amine compound represented by general formula (1) is preferably set to a value within the range of from 30 to 80 parts by weight based on 100 parts by weight of the binding resin.

The reason is that when the addition amount of the hole transfer agent having a specific structure is made to be in such a range, the oxidation resistance of the hole transfer agent having a specific structure can be effectively exhibited, and also the dispersibility in the photo sensitive layer also can be further improved.

In other words, the reason is that when the addition amount of the hole transfer agent having a specific structure is made to be below 30 parts by weight, its absolute amount lacks and it may be difficult not only to sufficiently exhibit the oxidation resistance but to obtain sufficient sensitivity, in some cases, while on the other hand, when the addition amount of the hole transfer agent having a specific structure exceeds a value of 80 parts by weight, the amine compound is prone to crystallize, so that it may be difficult to uniformly disperse it in the photo sensitive layer.

Consequently, the addition amount of the hole transfer agent having a specific structure is more preferably set to a value within the range of from 35 to 75 parts by weight, still more preferably a value within the range of from 40 to 70 parts by weight, based on 100 parts by weight of the binding resin.

Next, referring to FIG. 4, the relationship between the addition amount of the hole transfer agent having a specific structure and the variation of a charging potential will be described.

Figure 4:
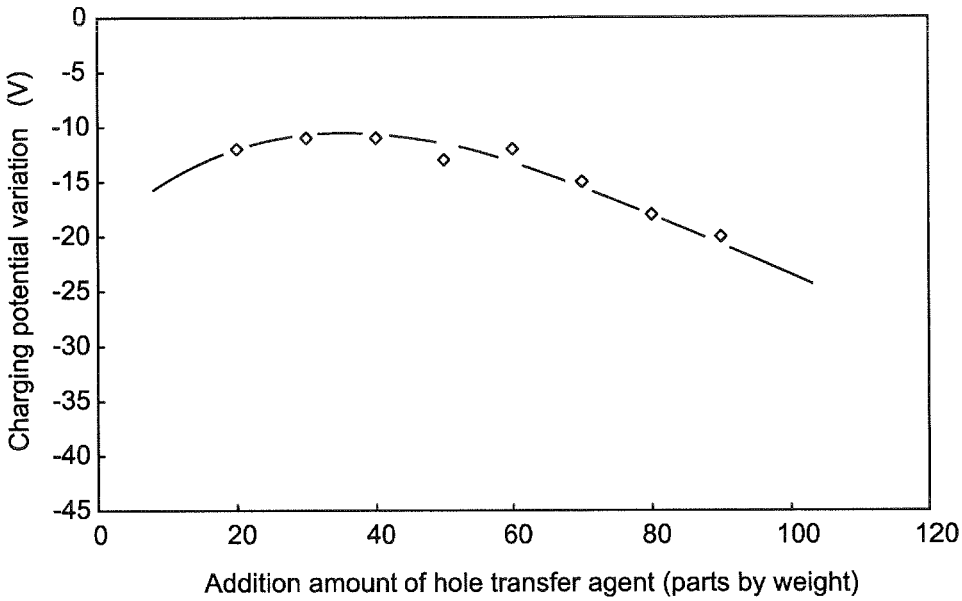
FIG. 4 is a graph for explaining a relationship between an addition amount of a hole transfer agent having a specific structure and variation of a charging potential.

FIG. 4 shows a characteristic curve in which the abscissa takes the addition amount (part by weight) of the hole transfer agent having a specific structure based on 100 parts by weight of the binding resin of the photo sensitive layer and the ordinate takes the variation (V) ((lapse charging potential)−(initial charging potential)) of charging potentials before and after implementation of continuous image formation.

In addition, the closer the variation of the charging potential is to 0 V in its value, the more stable the charging property is, which indicates an excellent charging property. Additionally, its measurement conditions and the like will be described in examples below.

This characteristic curve shows that as the addition amount of the specific hole transfer agent increases from 0 part by weight to 30 parts by weight, the variation of the charging potential gradually increases from a value of −15 V or less to a value of roughly −10 V.

When the addition amount of the specific hole transfer agent is in the range of from 30 to 80 parts by weight, although the variation of the charging potential gradually decreases along with its increase in addition amount, the variation stably keeps values of roughly −15 V.

Additionally, it is found that even in a range in which the addition amount of the specific hole transfer agent exceeds 80 parts by weight, the variation of the charging potential subsequently gradually continues to decrease, while if the variation reaches roughly 90 parts by weight, the variation of the charging potential can be made to keep in values of roughly −20 V.

Consequently, the graph shows that unless the addition amount of the specific hole transfer agent is extremely too small or too large, the variation of the charging potential can be suppressed in a wide range of the addition amount.

On the other hand, when also taking into account, for example, securing of minimum charging transfer ability, and dispersibility of the hole transfer agent in the photo sensitive layer, it can be said that the addition amount of the specific hole transfer agent is preferably set to a value within the range of from 30 to 80 parts by weight based on 100 parts by weight of the binding resin.

Next, referring to FIG. 5, the relationship between the variation of a charging potential and the generation of fogging will be described when a scorotron charging device is used.

Figure 5:
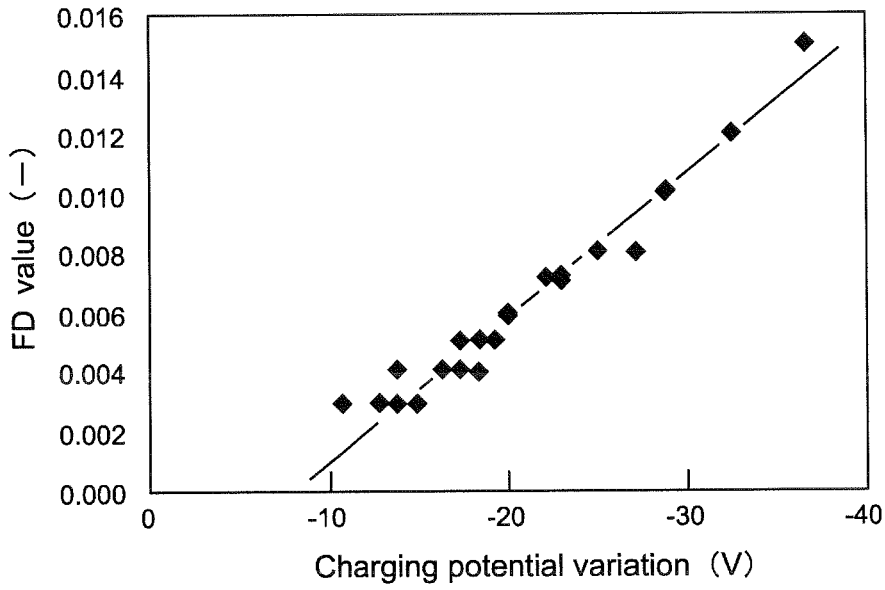
FIG. 5 is a graph for explaining a relationship between the variation of the charging potential and an FD value (generation of fogging).

FIG. 5 shows characteristics in which the abscissa takes the variation (V) ((lapse charging potential)−(initial charging potential)) of charging potentials before and after implementation of continuous image formation and the ordinate takes the fogging density value (FD value) (−), when a scorotron charging device is used at the time of charging.

Moreover, the graph shows that the higher the FD value, the stronger the generation of fogging. In addition, the measurement conditions and the like of the FD value will be described in examples below.

The characteristic curve shows that as the variation of the charging potential increases, the FD value rapidly decreases.

More specifically, when the variation of the charging potential is about −40 V, the FD value is high, at about 0.016; when the variation of the charging potential is about −30 V, the FD value is at roughly 0.010; when the variation of the charging potential is about −20 V, the FD value is a low value of about 0.006; and further, when the variation of the charging potential is about −10 V, the FD value is a very low value of roughly 0.002.

Hence, such a characteristic curve shows that when a scorotron charging device is used for charging, there is a clear correlation between the variation of a charging potential and the generation of fogging, and the variation of the charging potential can be suppressed to thereby enable the generation of fogging to be restrained. As the result, it is found that the use of the hole transfer agent having a specific structure makes it possible to effectively suppress the generation of fogging.

(3) Electron Transfer Agent (3)-1 Kind

A conventionally well-known electron transfer agent can be used as the electron transfer agent used in the present invention. Examples thereof include a single kind or a combination of two or more kinds of, in addition to diphenoquinone derivatives, pyrene derivatives and benzoquinone derivatives, anthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracynoethylene, 2,4,8-trinitrothioxanthone, dinitrobenzene, dinitroanthracene, dinitroacridine, nitroanthraquinone, dinitroanthraquinone, succinic anhydride, maleic anhydride and dibromomaleic anhydride.

(3)-2 Addition Amount

In addition, the addition amount of the electron transfer agent is preferably set to a value within the range of from 10 to 100 parts by weight based on 100 parts by weight of the binding resin.

The reason is that when the addition amount of the electron transfer agent becomes a value of below 10 parts by weight, the sensitivity is decreased, thereby generating a practical disadvantage, while on the other hand, when the addition amount of the electron transfer agent becomes a value exceeding 100 parts by weight, the electron transfer agent is liable to crystallize, so that a suitable film as a photoconductor may not be formed.

As such, the addition amount of the electron transfer agent is more preferably set to a value within the range of from 20 to 80 parts by weight.

Additionally, upon determination of the addition amount of the electron transfer agent, the addition amount of the hole transfer agent is preferably taken into account. More specifically, the ratio of addition of the electron transfer agent (total ETM) (total ETM/total HTM) is preferably set to a value within the range of from 0.25 to 1.3 based on the hole transfer agent (total HTM).

The reason is that when the ratio of such a total ETM/total HTM becomes a value out of the range, the sensitivity is decreased to generate a practical disadvantage in some cases.

Therefore, the ratio of total ETM/total HTM is more preferably set to a value within the range of from 0.5 to 1.25.

(4) Charge Generating Agent (4)-1 Kind

Moreover, a conventionally well-known charge generating agent can be used as the charge generating agent used in the present invention.

Examples thereof include a single kind or a mixture of two or more kinds of organic photo-electroconductors such as phthalocyanine pigments, perylene pigments, bisazo pigments, dioketopyrrolopyrrole pigments, non-metal naphtharocyanine pigments, metal naphtharocyanine pigments, squaraine pigments, trisazo pigments, indigo pigments, azulenium pigments, cyanine pigments, pyrylium pigments, anthanthrone pigments, triphenylmethane pigments, threne pigments, toluidine pigments, pyrazoline pigments and quinacridone pigments, and inorganic photo-electroconductors such as selenium, selenium-tellurium, selenium-arsenic, cadmium sulfate and amorphous silicon.

(4)-2 Addition Amount

The addition amount of the charge generating agent is preferably set to a value within the range of from 0.2 to 40 parts by weight based on 100 parts by weight of the binding resin.

The reason is that when the addition amount of the charge generating agent becomes a value of below 0.2 part by weight, the effect of enhancing the quantum yield becomes insufficient, so that the sensitivity, electric property, stability and the like of the electrophotographic photoconductor cannot be improved, while on the other hand, when the addition amount of the charge generating agent becomes a value exceeding 40 parts by weight, the effect of enlarging the absorption coefficient to light having a wavelength in a red region in visible light, the near infrared region or the infrared region becomes insufficient, thereby being incapable of improving the sensitivity behavior, electric property, stability and the like of the photoconductor in some cases.

Hence, the addition amount of the charge generating agent is more preferably set to a value within the range of from 0.5 to 20 parts by weight.

(5) Binding Resin

Additionally, examples of the binding resins used in the present invention include thermoplastic resins such as styrene copolymers, styrene-butadiene copolymers, styrene-acrylonitrile copolymers, styrene-maleic acid copolymers, acrylic copolymers, styrene-acrylic copolymers, polyethylene, ethylene-vinyl acetate copolymers, chlorinated polyethylene, poly(vinyl chloride), polypropylene, vinyl chloride-vinyl acetate copolymers, polyester, alkyd resins, polyamides, polyurethane, polycarbonate, polyacrylate, polysulfone, diallylphathalate resins, ketone resins, polyvinyl butyral resins and polyether resins, silicone resins, epoxy resins, phenol resins, urea resins, melamine resins and other crosslinking thermosetting resins, and photo-curing resins such as epoxy-acrylate and urethane-acrylate. These resins can be used alone or in combination of two or more kinds.

(6) Thickness

Moreover, the thickness of the photo sensitive layer in the present invention is preferably set to a value within the range of from 5 to 100 μm.

The reason is that when the thickness of the photo sensitive layer becomes a value of below 5 μm, the photo sensitive layer may be difficult to form uniformly, and the mechanical strength is lowered in some cases, while on the other hand, the thickness of the photo sensitive layer becomes a value exceeding 100 μm, the photo sensitive layer may be liable to peel off the substrate.

Therefore, the thickness of the photo sensitive layer is more preferably set to a value within the range of from 10 to 50 μm, still more preferably set to a value within the range of from 15 to 45 μm.

(7) Rotational Speed

Further, the rotational speed of the electrophotographic photoconductor is preferably set to a value within the range of from 70 to 280 mm/sec.

The reason is that even when the image forming apparatus of the present invention performs image formation at a wide variety of speeds, the variation of the charging potential can be decreased to effectively restrain the generation of fogging.

That is because on the other hand, when the rotational speed of the electrophotographic photoconductor becomes a value of below 70 mm/sec, effective high speed printing may be limited, while on the contrary, when the rotational speed of the electrophotographic photoconductor becomes a value exceeding 280 mm/sec, a current applied to the charging means when the electrophotographic photoconductor is charged becomes accordingly excessively large in some cases, which makes the variation of a charging potential extremely large, being prone to generate fogging in some cases.

As a result, the rotational speed of the electrophotographic photoconductor is more preferably set to a value within the range of from 100 to 250 mm/sec, still more preferably a value within the range of from 150 to 230 mm/sec.

Figure 6:
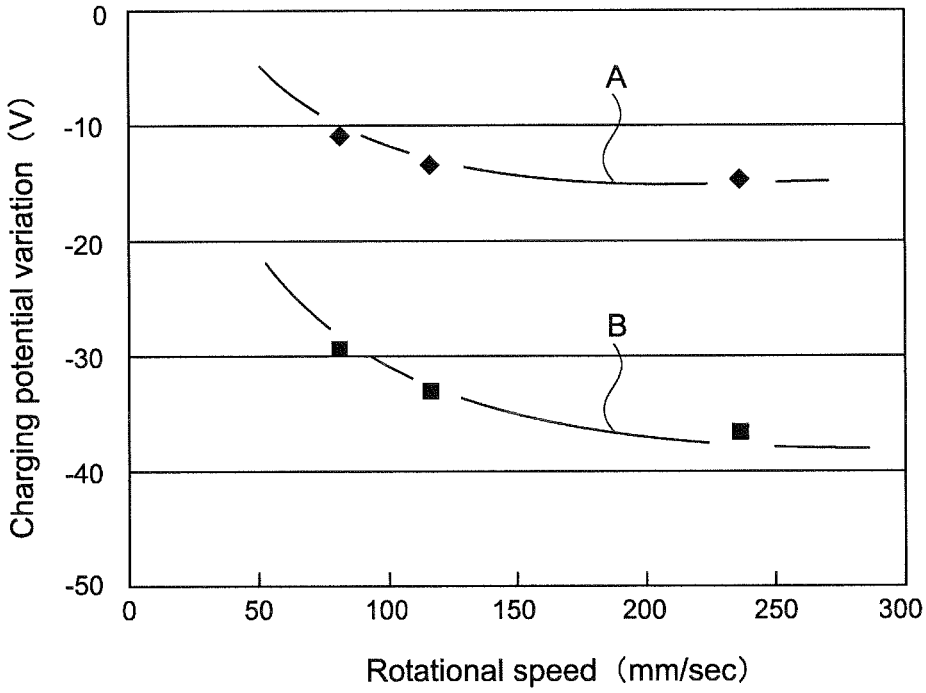
FIG. 6 is a graph for explaining a relationship between a rotational speed and the variation of the charging potential.
Figure 7:
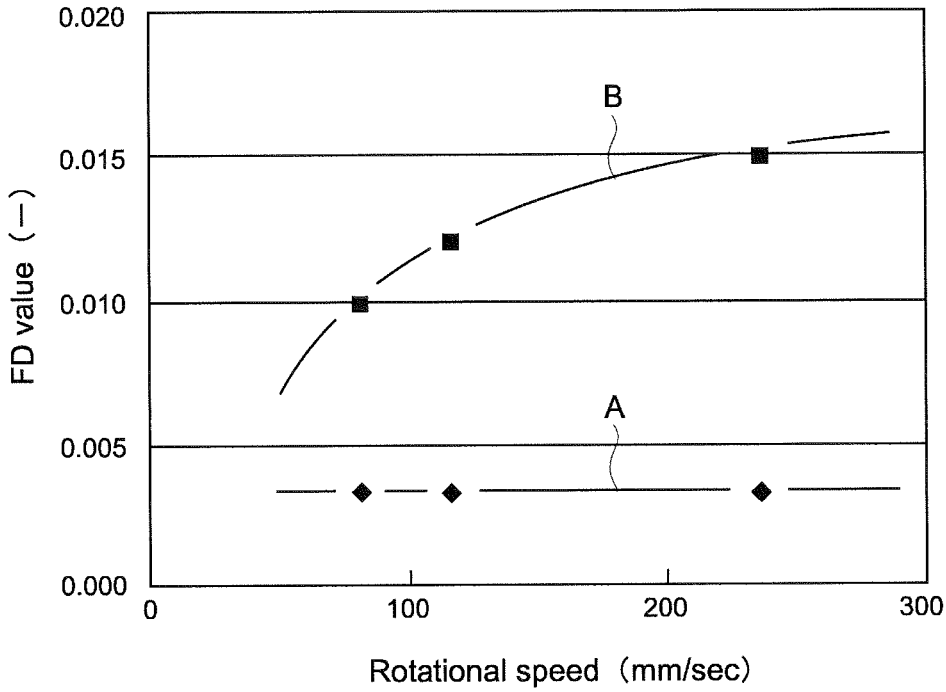
FIG. 7 is a graph for explaining a relationship between the rotational speed and the FD value (generation of fogging).

As illustrated in the line B of FIG. 6, it is ascertained that when the rotational speed of a conventional electrophotographic photoconductor (corresponding to Comparative Example 1) is in the range of from 70 to 280 mm/sec, the variation of the potential decrease is extremely large, at −30 V to −40 V. Hence, as indicated in the line B of FIG. 7, in the conventional electrophotographic photoconductor (corresponding to Comparative Example 1), as the rotational speed (mm/sec) becomes large, fogging properties are deteriorated, being prone to enlarge the FD value.

On the other hand, as shown in the line A of FIG. 6, it is ascertained that even when the rotational speed of an electrophotographic photoconductor of the present invention (corresponding to Example 1) is in the range of from 70 to 280 mm/sec, the variation in potential decrease is roughly from −10 V to −15 V. As a result, as illustrated in the line A of FIG. 7, the electrophotographic photoconductor of the present invention (corresponding to Example 1) is rarely affected by the rotational speed (mm/sec) and thus obtains excellent fogging properties, so that the FD value tends to be low.

Even when the rotational speed of the electrophotographic photoconductor of the present invention (corresponding to Example 1) is at 150 mm/sec, a good relationship is obtained between the variation in a predetermined potential (V) and the FD value (−) exhibiting fogging properties.

Consequently, when such a monolayer type electrophotographic photoconductor is used and also a ratio of a current value applied to charging means to a projection area of the charging means per time relative to the photo sensitive layer surface is controlled to be in a predetermined range (5 to 25 $\mu A/cm^2$), for example, the variation of the charging potential is controlled to be a value within the range of from −20 to 0 V, it is possible to control the FD value to be 0.006 or less.

Second Embodiment

A second embodiment of the present invention is an image forming method using the image forming apparatus described in the first embodiment.

In other words, the second embodiment is an image forming method using an image forming apparatus including charging means, exposure means, developing means, transfer means and electricity removing means arranged in this order around a periphery of an electrophotographic photoconductor, wherein, when a projection area of the charging means per time relative to a photo sensitive layer surface of the electrophotographic photoconductor is set to be S ($cm^2$) and a current value applied to the charging means is set to be $I_{CC}$ (μA), an inflow current value represented by $I_{CC}/S$ ($\mu A/cm^2$) is set to a value within the range of from 5 to 25 $\mu A/cm^2$, and the electrophotographic photoconductor is a monolayer type electrophotographic photoconductor containing in a same layer an charge generating agent, a hole transfer agent, an electron transfer agent and a binding resin, and also an amine compound represented by general formula (1) is contained as the hole transfer agent.

The configurations already described in the first embodiment are omitted and, points of the second embodiment different from those of the first embodiment will be primarily described below.

First, upon the implementation of the image forming method of the second embodiment, the image forming apparatus 10 as illustrated in FIG. 1 can be suitably used.

Herein, FIG. 1 is a schematic diagram showing the entire construction of an image forming apparatus and its operation will be described step by step hereinafter.

First, the photoconductor 11 of the image forming apparatus 10 is rotated at a predetermined process speed (circumferential speed) in a direction indicated by arrow A, and then its surface is charged to a predetermined potential by the charging means 12.

Next, the surface of the photoconductor 11 is exposed by the exposure means 13 via a reflection mirror or the like while being light modulated according to image information. This exposure allows an electrostatic latent image to be formed on the surface of the photoconductor 11.

Next, a latent image is developed by the developing means 14 on the basis of the electrostatic latent image. A toner is housed within the developing means 14, and this toner is affixed in correspondence to the electrostatic latent image on the surface of the photoconductor 11 to form a toner image.

In addition, the recording sheet 20 is conveyed to a lower portion of the photoconductor along a predetermined transfer carrier route. During this time, a predetermined transfer bias is applied between the photoconductor 11 and the transfer means 15 to allow the toner image to be transferred onto the recording material 20.

Next, the recording sheet 20 after transfer of the toner image is separated from the surface of the photoconductor 11 by means of separating means (not shown) to be conveyed to a fixing device on a conveying belt. Then, the sheet is heated and pressing treated by the fixing device and the toner image is fixed on its surface, and then the sheet is discharged to the outside of the image forming apparatus 10 by a discharging roller.

On the other hand, the photoconductor 11 after transfer of the toner image is continuously rotated and a residual toner (deposit) not transferred onto the recording sheet 20 during transfer is removed from the surface of photoconductor 11 by the cleaning device 17.

Additionally, the charge remaining on the surface of the photoconductor 11 is completely removed by irradiation with potential removing light from the electricity removing means 18 and supplied to the next image formation.

Therefore, the use of the image forming apparatus of the present invention, although a monolayer type electrophotographic photoconductor that is readily constituted is used, makes it possible to decrease the variation of a charging potential and effectively suppress the generation of fogging even when either a contact charging system or a non-contact charging system is adopted.

Consequently, a high quality image can be readily and inexpensively formed.

EXAMPLE

Example 1

1. Production of Electrophotographic Photoconductor

In an agitating container, placed were 2.7 parts by weight of an X type non-metal phthalocyanine (CGM-1) represented by the following formula (13) as a charge generating agent, 50 parts by weight of the amine compound (HTM-1) represented by formula (3) as a hole transfer agent, 35 parts by weight of a quinone compound (ETM-1) represented by the following formula (14) as an electron transfer agent, 100 parts by weight of a bisphenol Z type polycarbonate resin having an average molecular weight of 30,000 as a binding resin and 700 parts by weight of tetrahydrofuran, and then, the resulting material was blended and dispersed for 50 hours by a ball mill to prepare an application liquid.

Next, the resulting application liquid was applied onto an electroconductive supporter constituted by an alumite element tube by means of a dip coat method, and then the support was hot-air dried at 130° C. for 45 minutes to obtain a monolayer type electrophotographic photoconductor having a film thickness of 30 μm and a diameter of 30 mm.

(13)

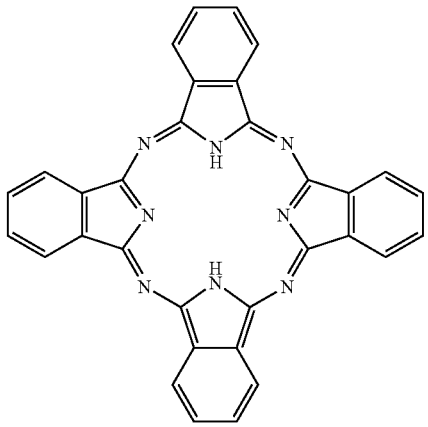

(CGM-1)

-continued (14)

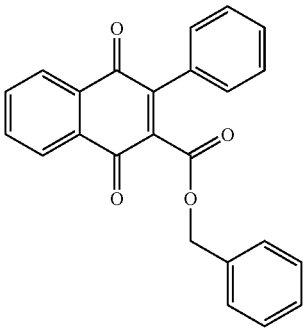

(ETM-1)

2. Evaluation (1) Evaluation of Variation of Charging Potential

The variation of a charging potential was evaluated by using an image forming apparatus provided with the electrophotographic photoconductor obtained and by changing the inflow current value ($I_{CC}/cm^2$) and the rotational speed of the electrophotographic photoconductor to the values shown in (i) to (iii) below.

(i)
Inflow current value: 7 μA/cm$^2$
Rotational speed: 84 mm/sec (ii)
Inflow current value: 10 μA/cm$^2$
Rotational speed: 120 mm/sec (iii)
Inflow current value: 20 μA/cm$^2$
Rotational speed: 240 mm/sec In other words, the electrophotographic photoconductor obtained was installed in a printer (FS-1020 remodeling machine, available from Kyocera Mita Corp.). Then, three-hour consecutive paper passing testing was carried out at the inflow current value and rotational speed of each of the above-listed values to measure the variation of charging potentials before and after the testing (V) ((lapse charging potential)−(initial charging potential)).

During the testing, a scorotron charging device to which only the direct current as indicated below was applied was used as the charging means, and the grid voltage was set such that the initial surface potential was 420 V in order to perform charging.

Wire: Gold plated tungsten
Wire diameter: 60 μm
Grid opening width: 10 mm (2) Fogging Evaluation In addition, fogging was evaluated by means of an image forming apparatus provided with the electrophotographic photoconductor obtained, by changing the inflow current value ($I_{CC}/cm^2$) and the rotational speed of the electrophotographic photoconductor as in the evaluation of the variation of the charging potential as described above, and by setting the initial surface potential such that the potential was 420 V.

In other words, the electrophotographic photoconductor obtained was installed in a printer (FS-1020 remodeling machine, available from Kyocera Mita Corp.). Then, three-hour consecutive paper passing testing was carried out at each inflow current value and each rotational speed, a white-paper image was printed, and the density in the white-paper printed image and the density in white paper (non-printed) were measured using a reflection density meter (TC-6D, available from Tokyo Denshoku Co., Ltd.). Next, the density in the white paper was subtracted from the density in the white-paper printed image to obtain a fogging density (FD value). The results obtained are listed in Table 1.

(3) Durability Test

Figure 8:
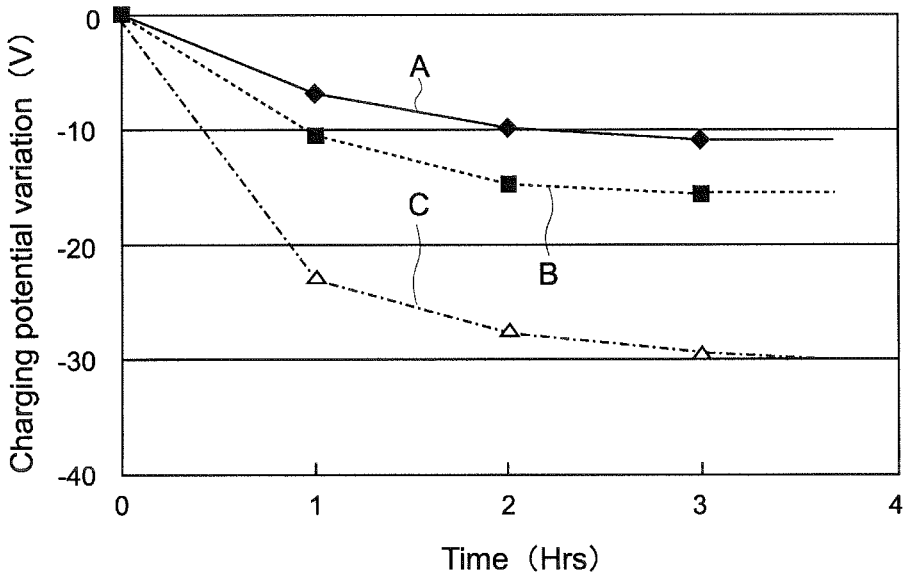
FIG. 8 is a graph for explaining a change with time lapse of the variation of the charging potential.

Additionally, the electrophotographic photoconductor obtained was installed in a printer (FS-1020 remodeling machine, available from Kyocera Mita Corp.). Then, subsequently three-hour consecutive paper passing was carried out such that the rotational speed of the electrophotographic photoconductor was set at 120 mm/sec, the inflow current value during charging such as $I_{CC}/cm^2$ was set at 7 μA/cm$^2$ and also the initial surface potential was set to be 420 V, during which the variation of a charging potential (V) ((lapse charging potential)−(initial charging potential)) was measured every one hour. The results are shown in FIG. 8 (line A).

Example 2

In Example 2, an electrophotographic photoconductor was produced and evaluated as in Example 1, except that the hole transfer agent used when producing the electrophotographic photoconductor was replaced by the amine compound (HTM-2) represented by formula (4). The results are indicated in Table 1.

Example 3

In Example 3, an electrophotographic photoconductor was produced and evaluated in the same manner as in Example 1, except that the hole transfer agent used when producing the electrophotographic photoconductor was replaced by the amine compound (HTM-3) represented by formula (5). The results are indicated in Table 1.

Example 4

In Example 4, an electrophotographic photoconductor was produced and evaluated in the same manner as in Example 1, except that the hole transfer agent used when producing the electrophotographic photoconductor was replaced by the amine compound (HTM-4) represented by formula (6). The results are indicated in Table 1.

Example 5

In Example 5, an electrophotographic photoconductor was produced and evaluated in the same manner as in Example 1, except that the hole transfer agent used when producing the electrophotographic photoconductor was replaced by the amine compound (HTM-5) represented by formula (7). The results are indicated in Table 1.

Example 6

In Example 6, an electrophotographic photoconductor was produced and evaluated in the same manner as in Example 1, except that the hole transfer agent used when producing the electrophotographic photoconductor was replaced by the amine compound (HTM-6) represented by formula (8). The results are indicated in Table 1.

In addition, in Example 6, durability testing was carried out and the variation (V) of the charge potential was measured every one hour, as in Example 1. The results obtained are indicated in Table 1 and FIG. 8 (line B).

Example 7

In Example 7, an electrophotographic photoconductor was produced and evaluated in the same manner as in Example 1, except that the hole transfer agent used when producing the electrophotographic photoconductor was replaced by the amine compound (HTM-7) represented by formula (9). The results are indicated in Table 1.

Example 8

In Example 8, an electrophotographic photoconductor was produced and evaluated in the same manner as in Example 1 except that the hole transfer agent used when producing the electrophotographic photoconductor was replaced by the amine compound (HTM-8) represented by formula (10). The results are indicated in Table 1.

Example 9

In Example 9, an electrophotographic photoconductor was produced and evaluated in the same manner as in Example 1, except that the hole transfer agent used when producing the electrophotographic photoconductor was replaced by the amine compound (HTM-9) represented by formula (11). The results are indicated in Table 1.

Example 10

In Example 10, an electrophotographic photoconductor was produced and evaluated in the same manner as in Example 1, except that the hole transfer agent used when producing the electrophotographic photoconductor was replaced by the amine compound (HTM-10) represented by formula (12). The results are indicated in Table 1.

Comparative Example 1

In Comparative Example 1, an electrophotographic photoconductor was produced and evaluated in the same manner as in Example 1, except that the hole transfer agent used when producing the electrophotographic photoconductor was replaced by an amine compound (HTM-11) represented by the following formula (15). The results are indicated in Table 1.

In addition, in Comparative Example 1, durability testing was carried out and the variation (V) of the charge potential was measured every one hour, as in Example 1. The results obtained are indicated in Table 1 and FIG. 8 (line C).

TABLE 1

(15)

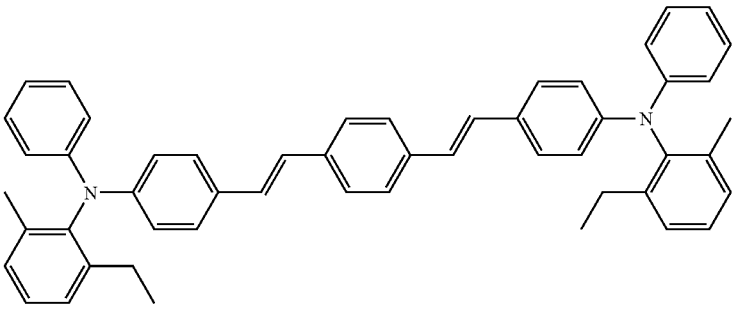

(HTM-11)

| | Hole transfer agent | Inflow current value: 7 μA/cm$^2$ Linear speed: 84 mm/sec | | Inflow current value: 10 μA/cm$^2$ Linear speed: 120 mm/sec | | Inflow current value: 20 μA/cm$^2$ Linear speed: 240 mm/sec | |
|---|---|---|---|---|---|---|---|
| | | Variation (V) | FD value (–) | Variation (V) | FD Value (–) | Variation (V) | FD value (–) |
| Example 1 | HTM-1 | −11 | 0.003 | −13 | 0.003 | −15 | 0.003 |
| Example 2 | HTM-2 | −11 | 0.003 | −13 | 0.003 | −15 | 0.003 |
| Example 3 | HTM-3 | −11 | 0.003 | −13 | 0.003 | −15 | 0.003 |
| Example 4 | HTM-4 | −14 | 0.003 | −18 | 0.004 | −20 | 0.006 |
| Example 5 | HTM-5 | −14 | 0.004 | −18 | 0.005 | −20 | 0.006 |
| Example 6 | HTM-6 | −16 | 0.004 | −19 | 0.005 | −23 | 0.007 |
| Example 7 | HTM-7 | −17 | 0.004 | −20 | 0.006 | −25 | 0.008 |
| Example 8 | HTM-8 | −17 | 0.004 | −20 | 0.006 | −25 | 0.008 |
| Example 9 | HTM-9 | −17 | 0.005 | −22 | 0.007 | −27 | 0.008 |
| Example 10 | HTM-10 | −20 | 0.006 | −23 | 0.007 | −29 | 0.010 |
| Comparative Example 1 | HTM-11 | −29 | 0.010 | −33 | 0.012 | −37 | 0.015 |

Examples 11 to 17

In Examples 11 to 17, electrophotographic photoconductors were produced in the same manner as in Example 1, except that the addition amounts of the hole transfer agents when the electrophotographic photoconductors were produced were changed, respectively, to 20, 30, 40, 60, 70, 80 and 90 parts by weight. Then, subsequently three-hour consecutive paper passing was carried out such that the rotational speeds of the electrophotographic photoconductors were set at 120 mm/sec, the inflow current values during charging such as $I_{CC}/cm^2$ were set at 10 $\mu A/cm^2$ and also the initial surface potentials were set to be 420 V, so as to evaluate the electrophotographic photoconductors as in Example 1. The results obtained are indicated in Table 2.

TABLE 2

| | Hole transfer agent | | Inflow current value: 10 $\mu A/cm^2$ Linear speed: 120 mm/sec | |
|---|---|---|---|---|
| | Kind | Addition amount (parts by weight) | Variation (V) | FD value (—) |
| Example 11 | HTM-1 | 20 | −12 | 0.003 |
| Example 12 | | 30 | −11 | 0.003 |
| Example 13 | | 40 | −11 | 0.003 |
| Example 14 | | 60 | −12 | 0.003 |
| Example 15 | | 70 | −15 | 0.004 |
| Example 16 | | 80 | −18 | 0.005 |
| Example 17 | | 90 | −20 | 0.006 |

According to an image forming apparatus according to the present invention and an image forming method using the image forming apparatus, an amine compound having a specific structure is used as a hole transfer agent contained in a photo sensitive layer and also a ratio of a current value applied to charging means to a projection area of the charging means per time relative to a photo sensitive layer surface is controlled to be in a predetermined range, whereby it is possible to effectively suppress the oxidation deterioration of the electrophotographic photoconductor due to ozone or the like, even in the case of a contact charging system, or a non-contact charging system or further even in the case where the rotational speed of an electrophotographic photoconductor is relatively high.

As a result, even when a monolayer type electrophotographic photoconductor is used as an electrophotographic photoconductor and the rotational speed of the electrophotographic photoconductor is high, the variation of a charging potential can be to be decreased, thereby to effectively suppress the generation of fogging.

Accordingly, an image forming apparatus according to the present invention and an image forming method using the image forming apparatus are expected to contribute to the acquisition of a high quality image formation, miniaturization, etc. of the image forming apparatus.

What is claimed is:

1. An image forming method using an image forming apparatus, the method comprising:

providing an image forming apparatus that includes a charging means which is a scorotron charging device, an exposure means, a developing means, a transfer means and an electricity removing means arranged in this order around a periphery of an electrophotographic photoconductor, repeatedly performing image formation by rotating the electrophotographic photoconductor at a predetermined process speed, charging a surface of the electrophotographic photoconductor to a predetermined potential using the charging means, exposing the electrophotographic photoconductor by the exposure means to allow formation of an electrostatic latent image on a surface of the electrophotographic photoconductor, forming a toner image corresponding to the electrostatic latent image, and applying a predetermined transfer bias between the photoconductor and the transfer means to allow the toner image to be transferred onto a recording material, setting a projection area of the charging means per time relative to a photo sensitive layer surface of the electrophotographic photoconductor to be S ($cm^2$) and a current value applied to the charging means to be $I_{CC}$ ($\mu A$), and setting an inflow current value represented by $I_{CC}/S$ ($\mu A/cm^2$) to a value within the range of from 5 to 25 $\mu A/cm^2$, controlling a variation (V) of a charging potential before and after repeatedly performing image formation, to be within the range of from about −20 to about 0 V, and providing, as the electrophotographic photoconductor, a monolayer type electrophotographic photoconductor containing in a same layer a charge generating agent, a hole transfer agent, an electron transfer agent and a binding resin, and also providing an amine compound represented by general formula (1) as the hole transfer agent:

(1)

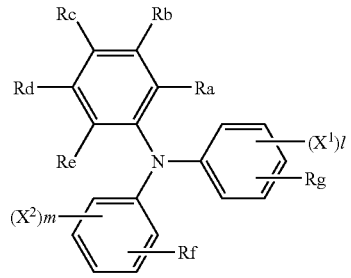

wherein Ra to Rg are each independently a hydrogen atom, a halogen atom, an alkyl group having 1 to 20 carbon atoms, an alkoxy group having 1 to 20 carbon atoms, or a substituted or unsubstituted aryl group having 6 to 30 carbon atoms, or two substituents of Ra to Re adjacent to each other may form a hydrocarbon ring structure; $X^1$ and $X^2$ are each independently a substituent represented by the following general formula (2), and when $X^1$ and $X^2$ or one of them is plural, each may be the same or different; and the substituent numbers l and m are 0 or positive integers satisfying ($l+m \geqq 2$):

(2)

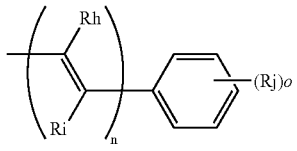

wherein Rh to Ri are each independently a hydrogen atom, an alkyl group having 1 to 20 carbon atoms, a substituted or unsubstituted aryl group having 6 to 30 carbon atoms; a repetition number n is an integer of 1 or 2; Rj is a halogen atom, an alkyl group having 1 to 20 carbon atoms, an alkoxy group having 1 to 20 carbon atoms, or a substituted or unsubstituted aryl group having 6 to 30 carbon atoms, and when Rj is plural, they may be the same or different; and the substituent number o is an integer of 0 to 5.

2. The image forming method using the image forming apparatus according to claim 1, comprising setting a rotational speed of the electrophotographic photoconductor to a value within the range of from 70 to 280 mm/sec.

3. The image forming method according to claim 2 comprising controlling the variation (V) of a charging potential to be a value within the range of from about −20 to about −10 V.

4. The image forming method using the image forming apparatus according to claim 1, comprising setting an addition amount of the amine compound represented by general formula (1) to a value within the range of from 30 to 80 parts by weight based on 100 parts by weight of the binding resin.

5. The image forming method using the image forming apparatus according to claim 1, wherein, in general formula (1), any two of Ra to Re are bonded to form a cyclohexyl group.

6. The image forming method using the image forming apparatus according to claim 1, wherein, in general formula (1), $X^1$ and $X^2$ or any one of them has a butadiene structure in which the repetition number n in general formula (2) is set to 2.

7. The image forming method according to claim 1 comprising controlling the variation (V) of a charging potential to be a value within the range of from about −20 to about −10 V.

* * * * *